US007098594B2

(12) United States Patent
Yoon et al.

(10) Patent No.: US 7,098,594 B2
(45) Date of Patent: Aug. 29, 2006

(54) PLASMA DISPLAY PANEL HAVING DELTA PIXEL ARRANGEMENT

(75) Inventors: Cha-Keun Yoon, Suwon (KR); Min-Sun Yoo, Cheonan (KR); Jung-Keun Ahn, Cheonan (KR); Yong-Jun Kim, Suwon (KR); Tae-Ho Lee, Ahsan (KR); Sung-Hune Yoo, Ahsan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 189 days.

(21) Appl. No.: 10/724,644

(22) Filed: Dec. 1, 2003

(65) Prior Publication Data

US 2004/0169473 A1 Sep. 2, 2004

(30) Foreign Application Priority Data

Jan. 22, 2003 (KR) ..... 10-2003-0004282

(51) Int. Cl.
*H01J 17/49* (2006.01)

(52) U.S. Cl. ..... 313/582

(58) Field of Classification Search ..... 313/581–587; 315/169.4; 345/41, 60
See application file for complete search history.

(56) References Cited

U.S. PATENT DOCUMENTS 5,182,489 A * 1/1993 Sano ..... 313/485
6,090,464 A * 7/2000 Yoo ..... 428/73
6,373,195 B1 4/2002 Whang et al.
6,376,986 B1 4/2002 Takagi et al.
6,806,645 B1 * 10/2004 Choi ..... 313/582
6,853,136 B1 * 2/2005 Kim et al. ..... 313/582
2001/0040539 A1 * 11/2001 Hashimoto ..... 345/60
2002/0021090 A1 * 2/2002 Sano et al. ..... 313/587

* cited by examiner

*Primary Examiner*—Ashok Patel
(74) *Attorney, Agent, or Firm*—Christie, Parker & Hale, LLP.

(57) ABSTRACT

A plasma display panel. A first substrate and a second substrate are provided at a predetermined distance from the first substrate and form a vacuum assembly with the first substrate. Barrier ribs form pixels between the first substrate and the second substrate such that subpixels forming one grouping of pixels are arranged in a triangular configuration. A plurality of address electrodes is formed on a surface of the first substrate facing the second substrate and along a first direction of the first substrate. A plurality of discharge sustain electrodes is formed on a surface of the second substrate facing the first substrate and along a first direction of the second substrate. A phosphor layer and a discharge gas are provided between the first substrate and the second substrate. If a length of a line passing through a center of the subpixels and interconnecting two opposing corners of the subpixels is (c), and if a length of a line extending between two adjacent corners is (b), the subpixels are formed such that a (b) to (c) ratio is between 1:1.5 and 1:5.

22 Claims, 5 Drawing Sheets

PLASMA DISPLAY PANEL HAVING DELTA PIXEL ARRANGEMENT

CROSS-REFERENCE TO RELATED APPLICATION

This application claims priority to and the benefit of Korean Application No. 2003-0004282, filed on Jan. 22, 2003 in the Korean Intellectual Property Office, the entire content of which is incorporated herein by reference.

BACKGROUND OF THE INVENTION (a) Field of the Invention

The present invention relates to a plasma display panel (PDP), and more particularly, to a plasma display panel in which red (R), green (G), blue (B) unit pixels are arranged in a triangular configuration, or what is referred to as a delta arrangement.

(b) Description of the Related Art

A plasma display panel (PDP) is typically a display device in which ultraviolet rays generated by the discharge of gas excites phosphors to realize predetermined images. As a result of the high resolution possible with PDPs (even with large screen sizes), many believe that they will become a major, next generation flat panel display configuration.

The PDP is classified depending on how its discharge cells are arranged. The two main types of PDPs are the stripe PDP, in which spaces defined by barrier ribs and where gas discharge takes place are arranged in a stripe pattern(or in-line pattern); and the delta PDP, in which the discharge cells are arranged in a triangular (i.e., delta) shape.

In the conventional delta PDP, a plurality of R,G,B unit pixels are formed in a delta configuration between an upper substrate and a lower substrate. At locations corresponding to the positions of the discharge cells, sustain electrodes are formed on the upper substrate and address electrodes are formed on the lower substrate. The delta arrangement of the R,G,B unit pixels may be realized, for example, by closed barrier ribs formed in a triangular shape.

In such a delta PDP, an address voltage is applied between an address electrode and one of a pair of sustain electrodes that correspond to the selected unit pixel to thereby perform addressing, and a discharge sustain voltage is applied alternatingly to the pair of the sustain electrodes to thereby perform a sustaining operation. As a result, ultraviolet rays generated in the sustaining process excite phosphors in the discharge cell such that the phosphors emit visible light to thereby realize desired images. The PDPs disclosed in U.S. Pat. Nos. 5,182,489 and 6,373,195 are examples of such a delta PDP.

The above delta PDPs are realized not only through closed barrier ribs, but may be formed using a structure in which the linear barrier ribs for the stripe PDP are changed in shape. U.S. Pat. No. 6,376,986 discloses such a PDP. In this patent, the R,G,B unit pixels are formed into substantially hexagonal shapes by barrier ribs arranged in a meander formation.

In the PDPs mentioned above, the unit pixels are arranged in a triangular formation as described above such that when the R,G,B phosphors are grouped together to form one pixel, a width of one R,G,B unit pixel may be made approximately one-third larger than a pitch (horizontal pitch) of the pixel. Therefore, the high definition is superior to the PDP in which the unit pixels are formed in an in-line configuration, and the area of the non-illuminating regions in the screen is reduced to thereby improve luminance.

Although the conventional delta PDP has these advantages, in the delta PDPs disclosed up to this point, the characteristics of the unit pixels are not realized such that the overall characteristics of the delta PDP (e.g., luminance) are unable to be maximized, thereby providing difficulties when producing the actual PDP.

For example, in the PDP of U.S. Pat. No. 6,376,986, instead of forming the unit pixels in a closed configuration, the unit pixels are formed by barrier ribs in a meander formation in which the unit pixels are open in a column direction. This limits any attempt at maximizing the discharge space of the unit pixels.

Further, in the PDP of U.S. Pat. No. 5,182,489, the unit pixels are realized through closed barrier ribs, making conditions favorable for maximizing the size of the discharge cells. However, as far as the relation between an area of the discharge sustain electrodes provided within the pixels and the diffusion of discharge within the quadrilateral pixels is concerned, the length of the discharge sustain electrodes in the vertical direction is shorter than with the hexagonal pixels such that the diffusion of discharge at a center area is blocked substantially faster by the barrier ribs in the horizontal direction. Therefore, a reduction in luminance characteristics compared to the PDP using hexagonal pixels results.

SUMMARY OF THE INVENTION

It is an advantage of the present invention to provide a plasma display panel that uses a delta configuration for the arrangement of unit pixels, in which the formation of the unit pixels is maximized for improving the characteristics of the plasma display panel.

A plasma display panel is provided which includes a first substrate and a second substrate provided at a predetermined distance from the first substrate and forming a vacuum assembly with the first substrate. Barrier ribs form pixels between the first substrate and the second substrate such that subpixels forming one grouping of pixels are arranged in a triangular configuration. A plurality of address electrodes is formed on a surface of the first substrate facing the second substrate and along a first direction of the first substrate. A plurality of discharge sustain electrodes is formed on a surface of the second substrate facing the first substrate and along a first direction of the second substrate. A phosphor layer and discharge gas are provided between the first substrate and the second substrate.

If a length of a line passing through a center of the subpixels and interconnecting two opposing corners of the subpixels is (c), and if a length of a line extending between two adjacent corners is (b), the subpixels are formed such that a (b) to (c) ratio is between 1:1.5 and 1:5. Preferably, the (b) to (c) ratio is between 1:2.5 and 1:3.5. Also, the subpixels are formed as hexagons.

Each of the discharge sustain electrodes includes a bus electrode formed along the first direction of the second substrate, and transparent electrode sections formed extending from the bus electrodes to be positioned within areas corresponding to the subpixels.

The bus electrodes are formed corresponding to a shape of the barrier ribs along the first direction of the second substrate. For example, the bus electrodes are formed in a zigzag configuration along the first direction of the second substrate.

The address electrodes include first area sections formed at a predetermined width and within an area covered by the barrier ribs, and second area sections formed at a predetermined width greater than the width of the first area sections and within areas encompassed by the subpixels.

The second area sections are formed in a shape similar to the shape of the subpixels, that is, in a hexagonal configuration.

In another aspect, a plasma display panel includes a first substrate and a second substrate, opposing one another with a predetermined gap therebetween to form a vacuum assembly. Barrier ribs form pixels between the first substrate and the second substrate such that subpixels forming one grouping of pixels are arranged in a triangular configuration. A plurality of address electrodes is formed on a surface of the first substrate facing the second substrate, along a first direction of the first substrate. A plurality of discharge sustain electrodes is formed on a surface of the second substrate facing the first substrate, along a first direction of the second substrate. A phosphor layer is formed between the first substrate and the second substrate, and discharge gas is filled in discharge cells defined by the barrier ribs forming the subpixels.

If a length of a line passing through a center of the discharge cells and interconnecting two opposing corners of the barrier ribs defining each of the discharge cells is (c), and if a length of a line extending between two adjacent corners of the barrier ribs defining each of the discharge cells is (b), the barrier ribs defining each of the discharge cells are formed such that a (b) to (c) ratio is between 1:1.5 and 1:5. Preferably, the (b) to (c) ratio is between 1:2.5 and 1:3.5.

DETAILED DESCRIPTION

Figure 1:
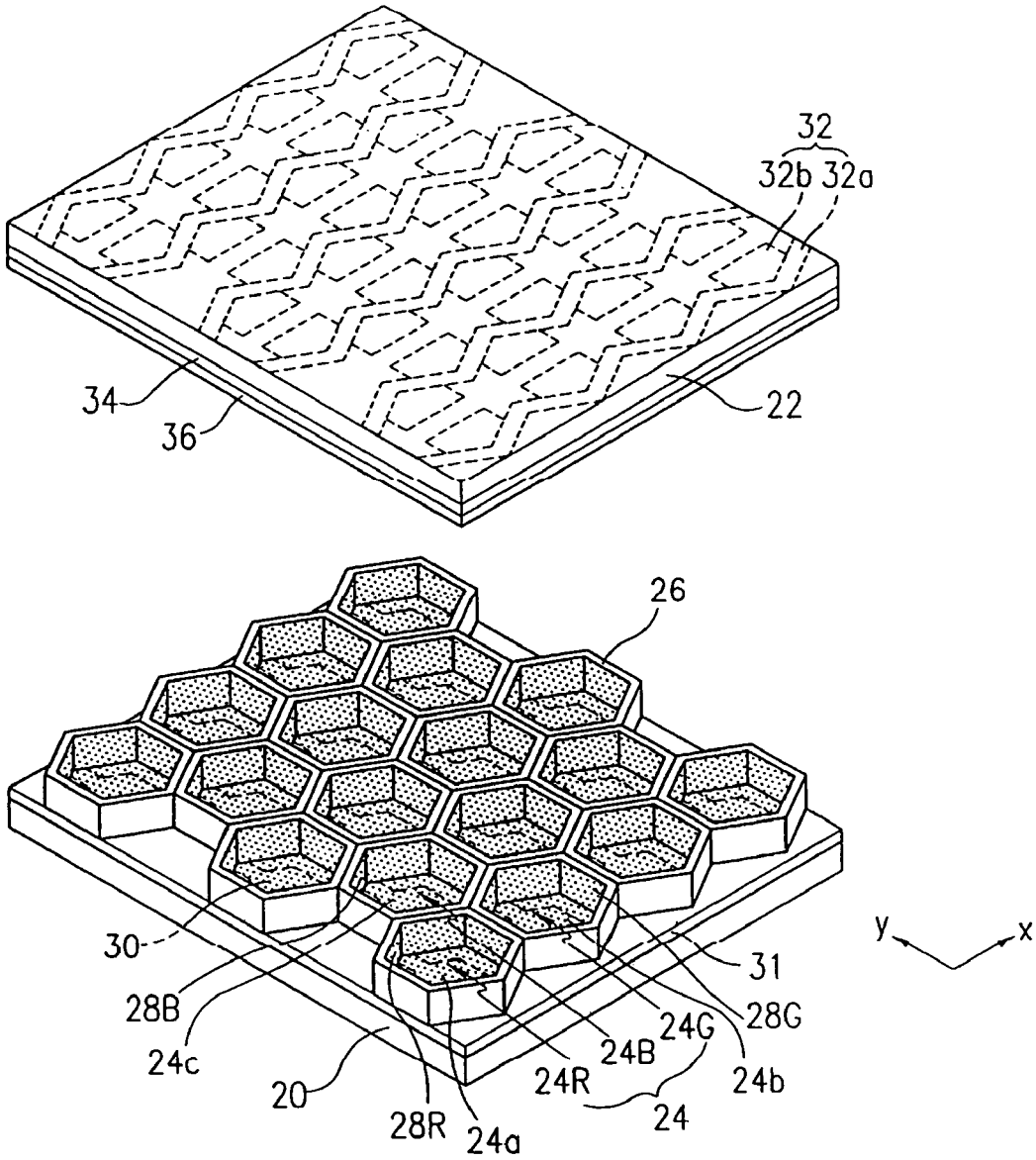
FIG. 1 is a partial exploded perspective view of a plasma display panel according to an embodiment of the present invention.
Figure 2:
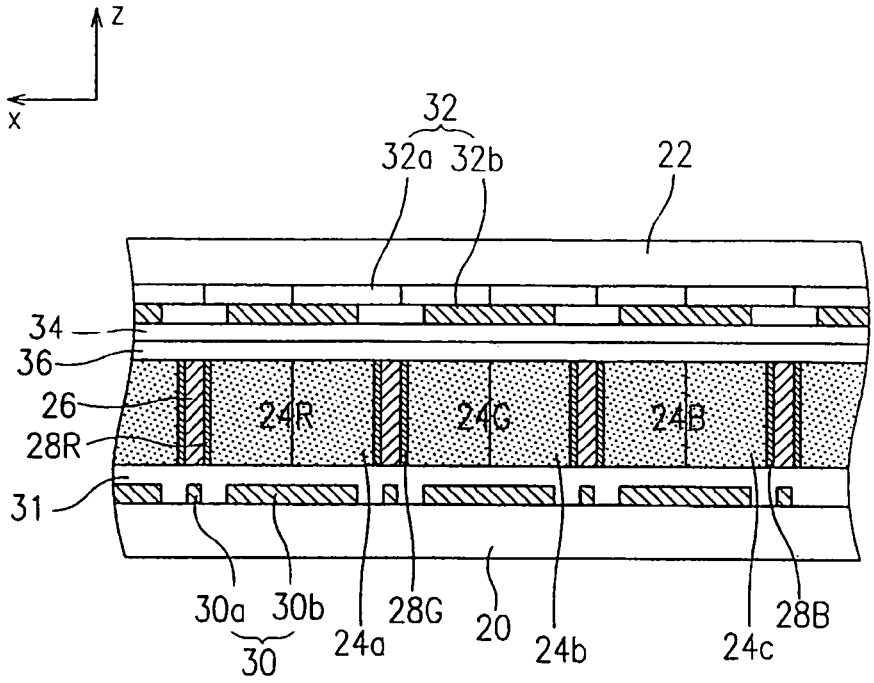
FIG. 2 is a partial sectional view of a plasma display panel according to an embodiment of the present invention.

FIG. 1 is a partial exploded perspective view of a plasma display panel according to an embodiment of the present invention, and FIG. 2 is a partial sectional view of a plasma display panel according to an embodiment of the present invention.

As shown in the drawings, in a plasma display panel (PDP) according to an embodiment of the present invention, R,G,B subpixels are arranged in groups into a triangular shape to thereby realize what is referred to as a delta PDP. The PDP of the present invention is more precisely a delta AC PDP.

The PDP includes first substrate 20 (hereinafter referred to as a lower substrate) and second substrate 22 (hereinafter referred to as an upper substrate). Lower substrate 20 and upper substrate 22 are provided substantially in parallel with a predetermined gap therebetween.

Figure 3:
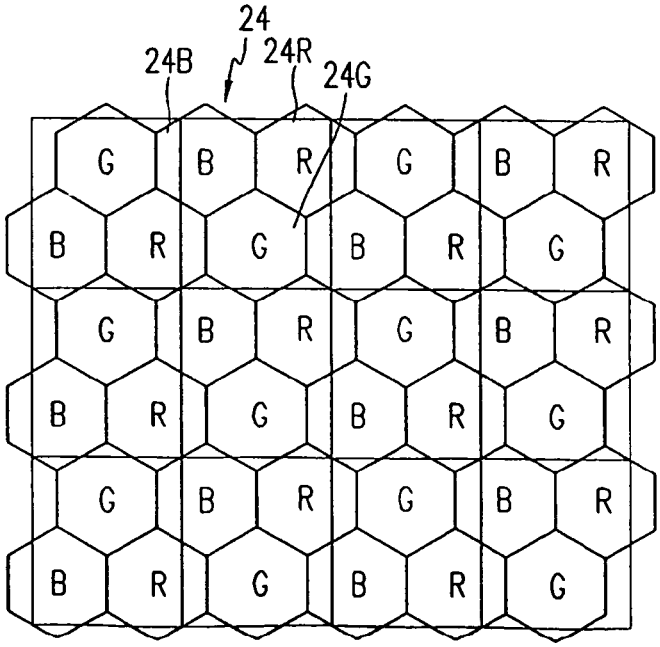
FIG. 3 is a schematic view used to describe a subpixel arrangement in a plasma display panel according to an embodiment of the present invention.

Barrier ribs 26 are formed to a predetermined height and in a predetermined pattern between lower substrate 20 and upper substrate 22 to thereby define pixels 24. Each grouping of pixels 24 includes three subpixels 24R, 24G, and 24B that are arranged in a triangular configuration (see also FIG. 3), with adjacent groups sharing select subpixels 24R, 24G, and 24B to form their delta shape. Barrier ribs 26 form subpixels 24R, 24G, and 24B, and define discharge cells 24*a*, 24*b*, and 24*c* respectively to the interior of subpixels 24R, 24G, and 24B.

Each of the subpixels 24R, 24G, and 24B is formed substantially as a hexagon. It follows, then, that barrier ribs 26 forming subpixels 24R, 24G, and 24B are formed into a plurality of hexagonal shapes, as are discharge cells 24*a*, 24*b*, and 24*c* that are defined by subpixels 24R, 24G, and 24B, respectively.

Discharge gas required for PDP operation is provided in discharge cells 24*a*, 24*b*, and 24*c*. Further, R, G, and B phosphor layers 28R, 28G, and 28B are formed in subpixels 24R, 24G, and 24B, respectively. Phosphor layers 28R, 28G, and 28B are formed along a bottom surface and side walls of discharge cells 24*a*, 24*b*, and 24*c* (i.e., along interior walls of barrier ribs 26).

A plurality of address electrodes 30 are formed along direction (y) on lower substrate 20. Address electrodes 30 are formed both covered and exposed by barrier ribs 26. Further, dielectric layer 31 is formed over an entire surface of lower substrate 20 opposing upper substrate 22 in such a manner that dielectric layer 31 covers address electrodes 30 but is formed under barrier ribs 26.

Figure 4:
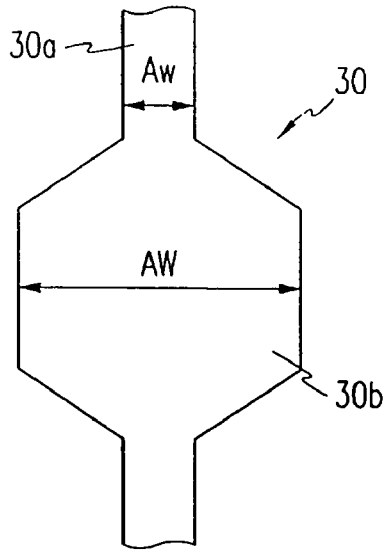
FIG. 4 is a schematic view of an address electrode in a plasma display panel according to an embodiment of the present invention.

Address electrodes 30 include first area sections 30*a*, which are formed outside of discharge cells 24*a*, 24*b*, and 24*c* but within (directly under) sections of barrier ribs 26 along direction (y); and second area sections 30*b*, which are formed within discharge cells 24*a*, 24*b*, and 24*c*. As shown in FIG. 4, first area sections 30*a* have a predetermined width Aw, while second area sections 30*b* have a predetermined width AW, which is greater than the width Aw of first area sections 30*b*.

This configuration is repeated along direction (y) for each address electrode 30, with first area sections 30*a* corresponding to positions under the sections of barrier ribs 26 formed along direction (y), and with second area sections 30*b* corresponding to positions within discharge cells 24*a*, 24*b*, and 24*c*. Also, second area sections 30*b* of address electrodes 30 are formed in substantially hexagonal shapes, corresponding to the shape of subpixels 24R, 24G, 24B.

With respect to upper substrate 22, a plurality of discharge sustain electrodes 32 are formed along direction (x) on a surface of upper substrate 22 opposing lower substrate 20. Discharge sustain electrodes 32 include bus electrodes 32*a* formed corresponding to the shape of barrier ribs 26 along direction (x), and transparent electrode sections 32*b* formed extending from bus electrodes 32*a* along direction (y) to be positioned corresponding to within discharge cells 24*a*, 24*b*, and 24*c* respectively of subpixels 24R, 24G, and 24B.

Bus electrodes 32*a* of discharge sustain electrodes 32 are realized using an opaque material such as metal, and their formation results in an overall zigzag shape along direction (x) by corresponding the shape of barrier ribs 26 along the same direction. It is preferable that a width of bus electrodes 32*a* is made small such that these elements are formed corresponding to positions fully within barrier ribs 26. This prevents bus electrodes 32*a* from blocking the visible light generated in discharge cells 24*a*, 24*b*, and 24*c* during operation of the PDP.

Further, transparent electrode sections 32*b* are made of a transparent material such as ITO. In order to be formed in areas corresponding to within discharge cells 24*a*, 24*b*, and 24*c*, transparent electrode sections 32*b* are formed at predetermined intervals along direction (x) of each of sub electrodes 32*a*, and protruding in direction (y) in an alternating fashion on opposite sides of each of bus electrodes 32*a*. With this configuration, two transparent electrode sections 32*b* correspond to locations of each of discharge cells 24*a*, 24*b*, and 24*c* as shown in FIG. 1 (when substrates 20 and 22 are assembled). Also, a predetermined gap is provided between transparent electrode sections 32*b* of adjacent discharge sustain electrodes 32, that is, the predetermined gap exists between the pairs of transparent electrode sections 32*b* corresponding to positions within each of the discharge cells 24*a*, 24*b*, and 24*c*.

Transparent dielectric layer 34 is formed over an entire surface of upper substrate 22 covering discharge sustain electrodes 32. Also, protection layer 36 realized through MgO is formed over dielectric layer 34.

Subpixels 24R, 24G, and 24B are formed satisfying the conditions described below. The conditions were established through repeated testing by the inventors, and were determined to be necessary to ensure improvement in essential PDP characteristics such as luminance and an addressing voltage margin.

Figure 5:
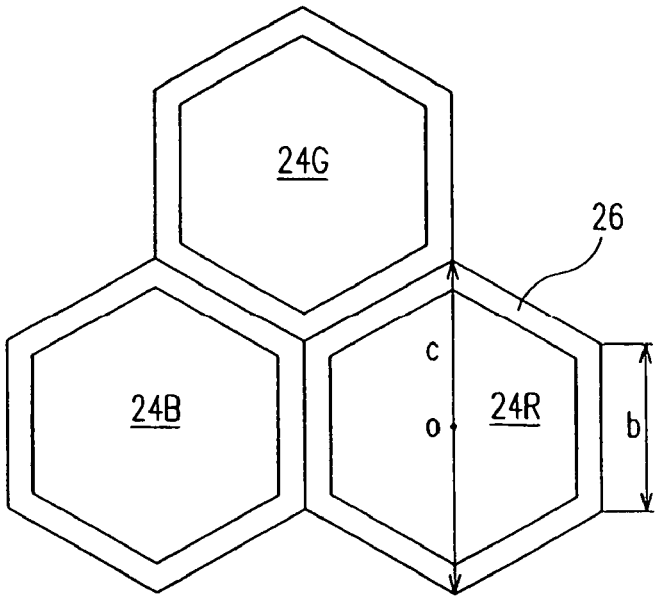
FIG. 5 is a schematic view used to describe the formation of a subpixel in a plasma display panel according to an embodiment of the present invention.

Using one of the R subpixels 24R of an R,G,B grouping as an example to describe all the subpixels 24R, 24G, 24B, and with reference to FIG. 5, subpixel 24R is symmetrical about a straight line drawn through a center (O) of subpixel 24R. The overall shape of subpixel 24R is that of a hexagon. Also, if a length of a line passing through the center (O) of subpixel 24R and extending from one corner to an opposite corner is (c), and a length of a line along any of the six edges of subpixel 24R is (b), the length (b) to length (c) ratio is from 1:1.5 to 1:5, and preferably 1:2.5 to 1:3.5.

The lengths (b) and (c) were described in the above as dimensions of sub electrodes 24R, 24G, and 24B. However, since sub electrodes 24R, 24G, and 24B are formed by barrier ribs 26, the lengths (b) and (c) may also be defined in relation to barrier ribs 26. In this case, using one of discharge cells 24*a* formed by barrier ribs 26 as an example, the length (c) is a length passing through a center of discharge cell 24*a* and interconnecting two opposite corners of hexagonal discharge cell 24*a* formed by barrier ribs 26, and the length (b) represents a length of one of the sides of hexagonal discharge cell 24*a* formed by barrier ribs 26. Discharge cell 24*a* is symmetrical about the line representing the length (c).

Figure 6:
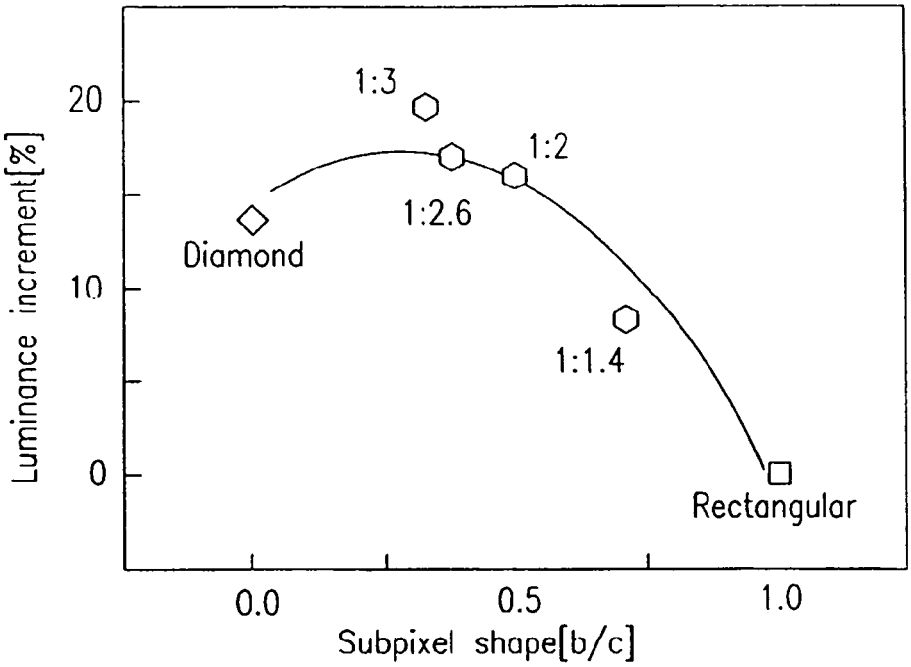
FIGS. 6, 7, and 8 are graphs used to describe the effects of a plasma display panel according to an embodiment of the present invention.
Figure 7:
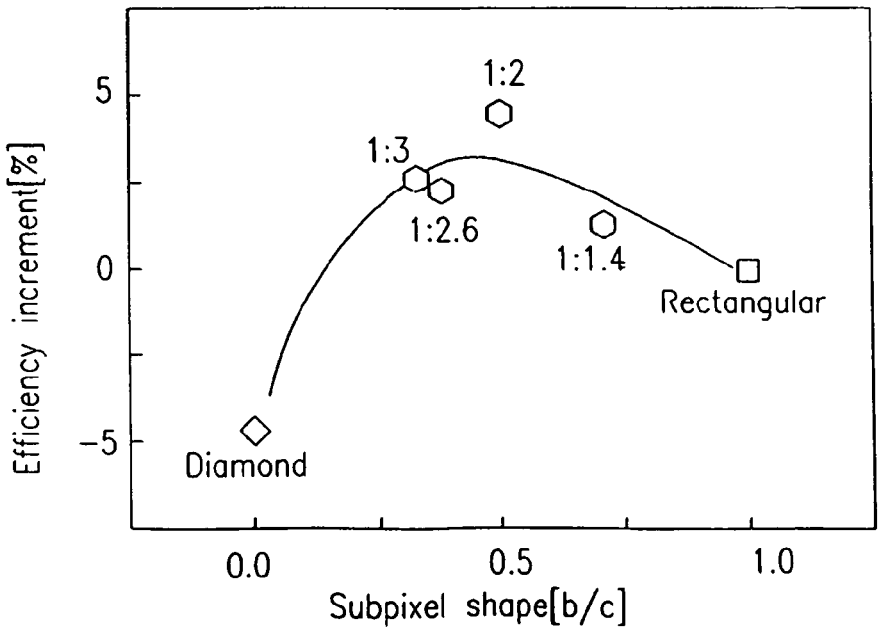
Figure 8:
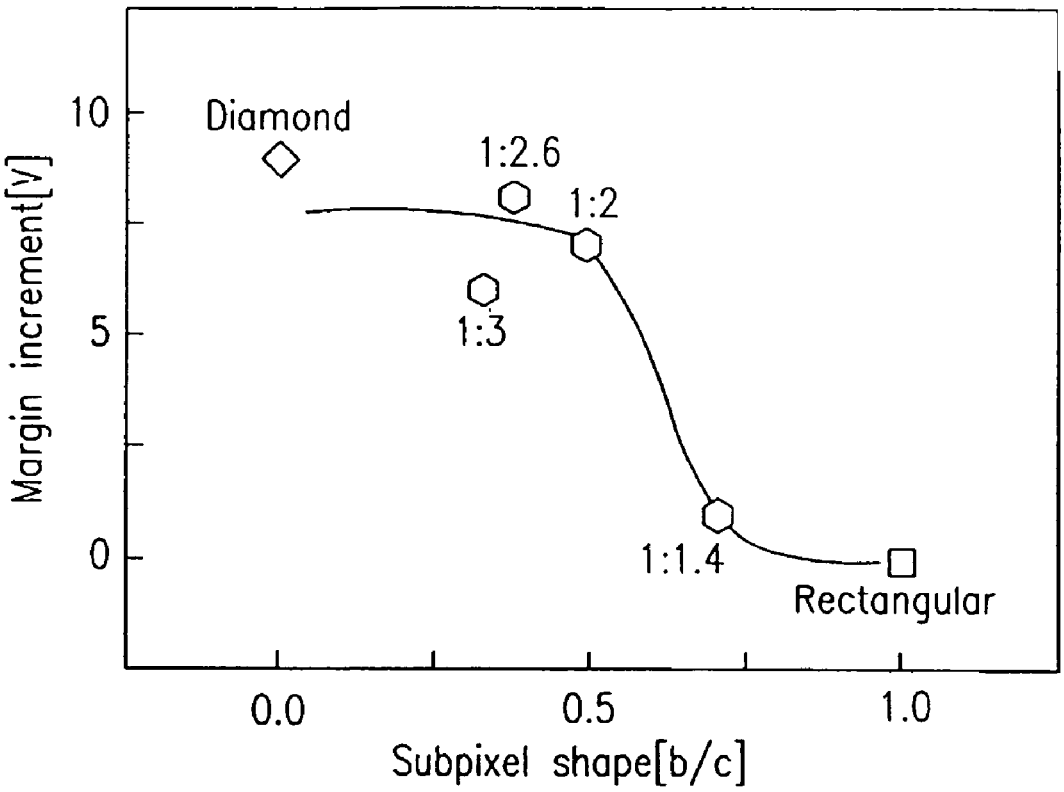

FIGS. 6, 7, and 8 are graphs used to describe the characteristics of a PDP to which subpixels are applied while satisfying the conditions described above. FIG. 6 shows luminance characteristics. FIG. 7 shows panel efficiency characteristics. FIG. 8 shows addressing voltage margin characteristics. The x-axis in each graph represents a value obtained by dividing the length (b) by the length (c), and the y-axis represents a value of the particular characteristic. Further, when performing the tests to derive the values of the graphs, the inventors varied only the lengths (b) and (c), and did not change any other dimensions such as the height of barrier ribs 26, and the thicknesses of dielectric layer 31 and phosphor layers 28R, 28G, and 28B.

Referring first to FIG. 6, compared to when the value of b/c is 1, that is, when subpixel 24R is formed into a conventional quadrilateral shape, the luminance of the panel is increased by at least 10% when the (b) to (c) ratio is 1:1.5 or greater. Further, when the (b) to (c) ratio is between 1:2 and 1:3, the luminance of the panel is increased by 15% or greater compared to when subpixel 24R is formed into the conventional quadrilateral shape. A slightly less than 15% increase in luminance is also obtained when the lengths (b) and (c) are such that subpixel 24R is formed into a diamond shape.

As shown in FIG. 7, when the (b) to (c) ratio of 1:1 is varied by increasing the length of (c), the efficiency of the PDP also increases. However, such an increase in efficiency occurs only to a point, after which efficiency decreases with continued increases in the length (c). If both the lengths (b) and (c) are varied such that subpixel 24 is formed into a diamond shape, display efficiency decreases considerably and is significantly less than in the conventional PDP utilizing a rectangular shape for the subpixels.

The efficiency of the panel is determined in the conventional manner, that is, by dividing the product of the illumination area A[$m^2$] and luminance L[$cd/m^2$] of the panel by the effective power consumed during discharge P_on P_off [W]. In the case of a panel that uses hexagonal unit pixels, since luminance and the area of the discharge sustain electrodes are increased, and power consumption is slightly increased, the illumination efficiency is somewhat enhanced. However, with the panel using diamond-shaped unit pixels, in which case the sub electrodes do not completely correspond with the barrier ribs, efficiency is decreased.

With respect to the addressing voltage margin, referring to FIG. 8, increasing the length (c) while leaving the length (b) the same results in improvements in the addressing voltage margin, with the highest addressing voltage margin being obtained when the lengths (b) and (c) are varied such that the subpixel 24 is formed into a diamond shape. However, with the formation of subpixel 24 into a diamond shape, barrier ribs 26 come to be too close to the center of subpixel 24, resulting in an unfavorable situation with respect to addressing discharge.

It is evident from the above as far as luminance and addressing voltage margin are concerned that favorable results are produced when subpixels 24 of the present invention are formed either into a diamond shape or approach such a configuration. However, when all panel characteristics are considered (including panel efficiency), a (b) to (c) ratio of between 1:1.5 and 1:5 is preferable, and, in the case where the pitch (horizontal) of the pixels is made minute (e.g., 0.576 mm) in order to make the PDP more high definition, a (b) to (c) ratio of between 1:2.5 and 1:3.5 is more preferable.

In the plasma display panel of the present invention described above, characteristics of the panel are improved by forming the subpixels having specific dimensions. Also, by forming the barrier ribs into hexagonal shapes, a stable in view of structure and the high definition of PDP is realized.

Although an embodiment of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

For example, although the subpixels were described as being formed by barrier ribs in a closed configuration, it is possible for the subpixels to be formed by curved linear barrier ribs that are not closed. Also, the subpixels are not limited to the hexagonal shape described above.

What is claimed is:

1. A plasma display panel, comprising:

a first substrate;

a second substrate provided at a predetermined distance from the first substrate and forming a vacuum assembly with the first substrate;

barrier ribs forming pixels between the first substrate and the second substrate such that subpixels forming one grouping of pixels are arranged in a triangular configuration;

a plurality of address electrodes formed on a surface of the first substrate facing the second substrate, and formed along a first direction of the first substrate;

a plurality of discharge sustain electrodes formed on a surface of the second substrate facing the first substrate, and formed along a first direction of the second substrate; and a phosphor layer and discharge gas provided between the first substrate and the second substrate, wherein if a length of a line passing through a center of the subpixels and interconnecting two opposing corners of the subpixels is (c), and if a length of a line extending between two adjacent corners and parallel with the line passing through the center of the subpixels and interconnecting two opposing corners of the subpixels is (b), the subpixels are formed such that a (b) to (c) ratio is between 1:1.5 and 1:5.

2. The plasma display panel of claim 1, wherein the (b) to (c) ratio is between 1:2.5 and 1:3.5.

3. The plasma display panel of claim 1, wherein the subpixels are formed as hexagons.

4. The plasma display panel of claim 1, wherein each of the discharge sustain electrodes includes a bus electrode formed along the first direction of the second substrate, and transparent electrode sections formed extending from the bus electrodes to be positioned within areas corresponding to the subpixels.

5. The plasma display panel of claim 4, wherein the bus electrodes are formed corresponding to a shape of the barrier ribs.

6. The plasma display panel of claim 5, wherein the bus electrodes are formed in a zigzag configuration along a direction of the second substrate.

7. The plasma display panel of claim 1, wherein the address electrodes include first area sections formed at a predetermined width and within an area covered by the barrier ribs, and second area sections formed at a predetermined width greater than the width of the first area sections and within areas encompassed by the subpixels.

8. The plasma display panel of claim 1, wherein the second area sections are formed in a shape similar to the shape of the subpixels.

9. The plasma display panel of claim 8, wherein the second area sections are formed in a hexagonal configuration.

10. The plasma display panel of claim 1, wherein the subpixels are symmetrical about a straight line passing through a center of the subpixels.

11. The plasma display panel of claim 1, wherein the line extending between two adjacent corners of the subpixels is parallel to the line passing through a center of the subpixels and interconnecting two opposing corners of the subpixels.

12. A plasma display panel, comprising:

a first substrate and a second substrate, opposing one another with a predetermined gap therebetween to form a vacuum assembly;

barrier ribs forming pixels between the first substrate and the second substrate such that subpixels forming one grouping of pixels are arranged in a triangular configuration;

a plurality of address electrodes formed on a surface of the first substrate facing the second substrate, and formed along a first direction of the first substrate;

a plurality of discharge sustain electrodes formed on a surface of the second substrate facing the first substrate, and formed along a first direction of the second substrate;

a phosphor layer formed between the first substrate and the second substrate; and discharge gas filled in discharge cells defined by the barrier ribs forming the subpixels, wherein if a length of a line passing through a center of the discharge cells and interconnecting two opposing corners of the barrier ribs defining each of the discharge cells is (c) and if a length of a line extending between two adjacent corners of the barrier ribs defining each of the discharge cells and parallel with the line passing through the center of the discharge cells and interconnecting two opposing corners of the barrier ribs defining each of the discharge cells is (b), the barrier ribs defining each of the discharge cells are formed such that a (b) to (c) ratio is between 1:1.5 and 1:5.

13. The plasma display panel of claim 12, wherein the (b) to (c) ratio is between 1:2.5 and 1:3.5.

14. The plasma display panel of claim 12, wherein the barrier ribs defining the discharge cells are formed as hexagons.

15. The plasma display panel of claim 12, wherein each of the discharge sustain electrodes includes a bus electrode formed along the first direction of the second substrate, and transparent electrode sections formed extending from the bus electrodes to be positioned within areas corresponding to the subpixels.

16. The plasma display panel of claim 15, wherein the bus electrodes are formed corresponding to a shape of the barrier ribs.

17. The plasma display panel of claim 16, wherein the bus electrodes are formed in a zigzag configuration along the first direction of the second substrate.

18. The plasma display panel of claim 12, wherein the address electrodes include first area sections formed at a predetermined width and within an area covered by the barrier ribs, and second area sections formed at a predetermined width greater than the width of the first area sections and within areas encompassed by the discharge cells.

19. The plasma display panel of claim 18, wherein the second area sections are formed in a shape similar to the shape of the subpixels.

20. The plasma display panel of claim 19, wherein the second area sections are formed in a hexagonal configuration.

21. The plasma display panel of claim 12, wherein the subpixels are symmetrical about a straight line passing through a center of the subpixels.

22. The plasma display panel of claim 12, wherein the line extending between two adjacent corners of the barrier ribs defining each of the discharge cells is parallel to the line passing through the center of the discharge cells and interconnecting two opposing corners of the barrier ribs defining each of the discharge cells.

* * * * *

UNITED STATES PATENT AND TRADEMARK OFFICE

CERTIFICATE OF CORRECTION

PATENT NO. : 7,098,594 B2
APPLICATION NO. : 10/724644
DATED : August 29, 2006
INVENTOR(S) : Yoon et al.

It is certified that error appears in the above-identified patent and that said Letters Patent is hereby corrected as shown below:

On the Title Page

| | |
|---|---|
| (56) References Cited<br>U.S. Patent Documents<br>6,806,645. . . | Delete "B1",<br>Insert --B2-- |
| (56) References Cited<br>U.S. Patent Documents<br>6,853,136. . . | Delete "Bl",<br>Insert --B2-- |

In the Claims

| | |
|---|---|
| Column 7, line 47, Claim 8 | Delete "claim 1",<br>Insert --claim 7-- |
| Column 8, line 15, Claim 12 | Delete "(c)",<br>Insert --(c),-- |

Signed and Sealed this

Tenth Day of July, 2007

JON W. DUDAS
*Director of the United States Patent and Trademark Office*